US011604007B2

(12) United States Patent
Mouratidis

(10) Patent No.: US 11,604,007 B2
(45) Date of Patent: Mar. 14, 2023

(54) TRAILING MEMBER TO REDUCE PRESSURE DROP ACROSS A DUCT MOUNTED SOUND ATTENUATING BAFFLE

(71) Applicant: VAW Systems Ltd., Winnipeg (CA)

(72) Inventor: Emanuel Mouratidis, Aurora (CA)

( * ) Notice: Subject to any disclaimer, the term of this patent is extended or adjusted under 35 U.S.C. 154(b) by 582 days.

(21) Appl. No.: 16/662,175

(22) Filed: Oct. 24, 2019

(65) Prior Publication Data

US 2020/0200434 A1 Jun. 25, 2020

Related U.S. Application Data

(60) Provisional application No. 62/781,932, filed on Dec. 19, 2018.

(51) Int. Cl.
*F24F 13/24* (2006.01)
*G10K 11/162* (2006.01)

(52) U.S. Cl.
CPC ..... *F24F 13/24* (2013.01); *G10K 11/162* (2013.01); *F24F 2013/242* (2013.01)

(58) Field of Classification Search
CPC ... G10K 11/162; F24F 13/24; F24F 2013/242
USPC ..... 181/224
See application file for complete search history.

(56) References Cited

U.S. PATENT DOCUMENTS 4,330,047 A * 5/1982 Ruspa ..... F24F 13/24 454/906
5,728,979 A * 3/1998 Yazici ..... F24F 7/08 181/224
5,803,409 A * 9/1998 Keefe ..... B64C 23/005 244/206
8,146,707 B2 * 4/2012 Choi ..... F24F 1/0047 181/198
10,041,697 B1 * 8/2018 Black ..... F24F 13/0227
10,458,589 B2 * 10/2019 Hill ..... F24F 13/24
10,722,990 B2 * 7/2020 Parmeshwar ..... B23P 15/04
11,300,321 B2 * 4/2022 McCune ..... F24F 11/65
2008/0061192 A1 * 3/2008 Sullivan ..... B64C 23/005 244/209
2008/0230305 A1 * 9/2008 Goto ..... G06F 1/182 181/224
2016/0251974 A1 * 9/2016 Slavens ..... F01D 17/162 60/806
2017/0219153 A1 * 8/2017 Hill ..... F16L 55/0331
2020/0094971 A1 * 3/2020 Etchessahar ..... F24F 7/04
2022/0082291 A1 * 3/2022 Zauderer ..... F24F 13/24

* cited by examiner

*Primary Examiner* — Forrest M Phillips
(74) *Attorney, Agent, or Firm* — Ryan W. Dupuis; Kyle R. Satterwaite; Ade & Company Inc.

(57) ABSTRACT

A sound attenuating baffle device has a baffle casing supported within a duct such that a boundary wall of the baffle device is oriented in the flow direction from the leading end to the trailing end of the baffle casing. The baffle casing includes a sound attenuating structure therein, and a trailing member protruding outwardly beyond the trailing end of the baffle casing towards a free trailing edge of the trailing member which is non-linear in profile. As compared to a continuous, straight trailing edge as found on most silencer outlets, a non-linear profile, for example a V-shaped or saw-toothed edge, improves the flow distribution along the height of the baffle or perimeter of the centerbody. The distribution of airflow across the resulting extended tail edge represents an improvement in the flow recovery.

18 Claims, 7 Drawing Sheets

PRIOR ART

TRAILING MEMBER TO REDUCE PRESSURE DROP ACROSS A DUCT MOUNTED SOUND ATTENUATING BAFFLE

This claims the benefit under 35 U.S.C. 119(e) of U.S. provisional application Ser. No. 62/781,932, filed Dec. 12, 2018.

FIELD OF THE INVENTION

The present invention relates to a sound attenuating baffle intended to be mounted within the duct of a heating, ventilation and air conditioning (HVAC) system, a fan ventilation system, mounted directly to a fan or other air movement system for either air or gas streams in which the baffle is typically oriented in the flow direction through the duct. More particularly the present invention relates to a sound attenuating baffle with an extended trailing edge, of the type including an outer baffle casing containing sound absorbing material therein.

BACKGROUND

Silencers are used in HVAC systems, fan ventilation systems and other air movement systems for either air and gas streams, in a fully-ducted or unducted installation. Silencers typically employ sound absorbing elements such as baffles (otherwise known as pods or splitters), in either a round or rectangular cross-sectional duct or support structure, such as a round or rectangular shaped casing. Silencers may include one baffle or several parallel baffles along the width of the duct or casing. The baffles may be uniform along the length, such as a rectangular or circular silencer, or may be transitional where the inlet cross-section is not equal to the outlet cross-section.

Silencers employ various shapes and configurations (e.g., straight, elbow, transitional types) in order to deliver a range of sound attenuation levels. The attenuation, typically measured as an Insertion Loss (IL; dB) may be directly improved through longer baffles and/or baffles with smaller air passages. These strategies used to deliver higher IL comes at an energy cost for the fan's motor or air movement device. As a result of higher airflow resistance or aerodynamic pressure drop (PD), due to longer baffles and/or smaller air passages, there may be a significant increase in the amount of work required to deliver a volume of air.

Accordingly, it is desired to reduce silencer PD with no adverse impacts on the IL, under minimal design complexity. For a given baffle orientation, a reduced PD will result in more efficient fan and air system installations, including reduced silencer size and weight.

As shown in FIG. 8, when using silencer baffles B in a ducted flow within a duct D, the baffles create a low pressure region immediately downstream of the baffles. This phenomena results in a turbulent flow recirculation region R that builds-up for a duct mounted baffle, under various thicknesses. Depending on the proportion of the baffle thickness relative to the duct width, the magnitude of the flow recirculation zone will vary. That is, the distance downstream from the baffle required for the flow to fully-recover (uniformly) will depend mainly on the flow intensity and baffle configuration.

A silencer's total PD may be influenced by a number of factors. As the air or gas flows towards a silencer exit or termination, a percentage of the static pressure is recovered as the dynamic pressure is reduced. This aerodynamic phenomenon may be called static regain.

It is known by those with ordinary skill in the art that improved flow recovery downstream from a silencer increases the static regain, resulting in a net reduction of the total PD. In every day practice, those with ordinary skill in the art apply smooth, diverging baffle shapes, with a gradually increasing air passage size that achieves the desired static pressure regain. Unfortunately, within a fixed duct length, this may result in a reduced baffle volume and a lower IL. More particularly, gradually increasing the air passage size within a fixed duct length requires the baffles to become thinner so that any sound attenuating structure within the baffle is reduced and the resulting sound attenuating effect is reduced.

Silencers are commonly installed in close proximity to other duct components or fans, positioned downstream from the baffle's outlet. This produces a phenomena known as system effects, where the interaction of the system components results in higher overall PD due to poor aerodynamic conditions. The literature suggests that the magnitude of the system effect may be 25 to 200% above the original silencer PD value. It is known by those with ordinary skill in the art that improved outlet flow diffusion or recovery will help reduce unwanted system effects between the silencer outlet and a duct or fan.

Within the field of unbounded flows, for example aircraft engines and fan blades, serrated or sawtooth shaped profiles have been used in order to reduce the overall sound levels related to aerodynamic induced noise. These serrations are only known for the mitigation of high velocity, free stream flow noise.

SUMMARY OF THE INVENTION

According to one aspect of the invention there is provided a sound attenuating baffle device for use in a duct receiving a gaseous flow in a flow direction therethrough from an inlet end to an outlet end of the duct, the baffle device comprising:

a baffle casing including at least one boundary wall spanning along one side of the baffle casing from a leading end to a trailing end of the baffle casing;

the baffle casing being adapted to be supported within the duct such that said at least one boundary wall is oriented in the flow direction and the gaseous flow is directed across said at least one boundary wall from the leading end to the trailing end of the baffle casing;

a sound attenuating structure within the baffle casing which is adapted to attenuate sound; and a trailing member associated said at least one boundary wall and supported on the baffle casing so as to protrude rearwardly away from the baffle casing in a direction of the boundary wall beyond the trailing end of the baffle casing towards a free trailing edge of the trailing member which is non-linear in profile.

The aerodynamics at the trailing edge forms a significant portion of the resultant exit loss and static regain, for both a rectangular baffle and a circular centerbody silencer. As shown in FIG. 9, use of a trailing member T at the trailing end of a sound attenuating baffle device B, results in a reduction of the length of the turbulent flow recirculation region R that trails the baffle B in the flow direction along the duct D. More particularly, the present invention has resulted in a reduction of the distance required for the flow to fully-recover downstream of the turbulent flow recirculation region R by at least 50%, with respect to the downstream direction of a ducted silencer. A reduced flow recovery distance results in improved static regain, significant reductions in the overall PD, and a reduction in unwanted system effects due to close-coupled duct components or fans immediately downstream from the silencer. The magnitude of this aerodynamic improvement depends on the flow velocity and the baffle height and thickness. As shown in FIGS. 5, 6 and 7, various trailing member profiles are viable, provided that the resulting extended length is significantly greater than the baffle's original trailing edge length.

According to a second aspect of the present invention there is provided a sound attenuating duct assembly comprising:

a duct for receiving a gaseous flow in a flow direction therethrough from an inlet end to an outlet end of the duct;

a baffle casing supported with the duct, the baffle casing including at least one boundary wall spanning along one side of the baffle casing so as to be oriented in the flow direction of the duct from a leading end to a trailing end of the baffle casing and so as to be arranged to receive the gaseous flow directed across said at least one boundary wall;

a sound attenuating structure within the baffle casing which is adapted to attenuate sound; and a trailing member associated said at least one boundary wall and supported on the baffle casing so as to protrude rearwardly away from the baffle casing in a direction of the boundary wall beyond the trailing end of the baffle casing towards a free trailing edge of the trailing member which is non-linear in profile.

According to a further aspect of the present invention there is provided a method of reducing pressure drop across a sound attenuating baffle device within a duct in which the duct receives a gaseous flow in a flow direction therethrough from an inlet end to an outlet end of the duct and in which the sound attenuating baffle device comprises (i) a baffle casing supported with the duct including at least one boundary wall spanning along one side of the baffle casing so as to be oriented in the flow direction of the duct from a leading end to a trailing end of the baffle casing and (ii) a sound attenuating structure within the baffle casing, wherein the method comprises:

providing a trailing member formed of rigid sheet material in association with said at least one boundary wall; and supporting the trailing member associated with said at least one boundary wall to protrude rearwardly away from the baffle casing in a direction of the boundary wall beyond the trailing end of the baffle casing towards a free trailing edge of the trailing member which is non-linear in profile.

As compared to a continuous, straight trailing edge as found on most silencer outlets, a non-linear profile, for example a V-shaped edge, improves the flow distribution along the height of the baffle or perimeter of the centerbody. The distribution of airflow across an extended tail edge represents an improvement in the flow recovery. Further, the non-linear trailing edge reduces the tendency of flow separation in an adverse pressure gradient for a wide range of Reynolds number. Accordingly, the present invention relates to an improved silencer trailing edge condition which incorporates a non-liner trailing member therein improving the flow diffusion at the silencer outlet and decreasing the overall PD. In the preferred embodiment, the non-linear profile is composed of a plurality of V-shaped, curved, or rectangular steps with a range of base and apex dimensions.

The trailing member is positioned along the baffle termination height (for rectangular sections) and along the termination radius (for circular centerbodies).

Various embodiments of the invention improve the flow recovery and reduce the silencer's PD while not adversely influencing the critical IL performance. Further, the invention uniquely reduces any adverse PD interactions related to duct components immediately downstream from the silencer, such as an elbow or fan inlet, as a result of the shorter flow recovery length.

Preferably the trailing member protrudes from a trailing edge portion of the baffle casing and the free trailing edge of the trailing member is significantly greater in length than the original trailing edge portion of the baffle casing.

The free trailing edge of the trailing member may be at least 50% longer than the trailing edge portion of the baffle casing. In some instances, the length could be 100% greater, that is the free trailing edge of the trailing member may be at least twice as long as the trailing edge portion of the baffle casing.

The trailing member is preferably formed of rigid sheet material. Preferably, the sheet material is substantially parallel to the boundary wall associated therewith. More preferably, the sheet material is substantially coplanar with the boundary wall associated therewith.

The free trailing edge preferably comprises a plurality of protruding elements mounted in series with one another in a row so as to define a recess between each adjacent pair of the protruding elements. The protruding elements and the recesses therebetween may be triangular, stepped, curved or sinusoidal in profile.

In some embodiments, each protruding element has a length extending rearwardly from the casing which is greater than a width of the protruding element in the direction of said row; however, in other embodiments, each protruding element has a width of the protruding element in the direction of said row which is greater than a length extending rearwardly from the casing. The ratio of protruding element length to width is dependent on the span or height of the baffle. For small baffle heights that may be approximately less than 36 inches or 1 metre in length, the length to width ratio is preferably greater than unity (e.g., protruding element length=3.0 inches; protruding element width=1.5 inches). For large baffle heights that may be approximately greater than 36 inches or 1 metre in length, the length to width ratio is equal to or less than unity (e.g., protruding element length=2.5 inches; protruding element width=3.0 inches).

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
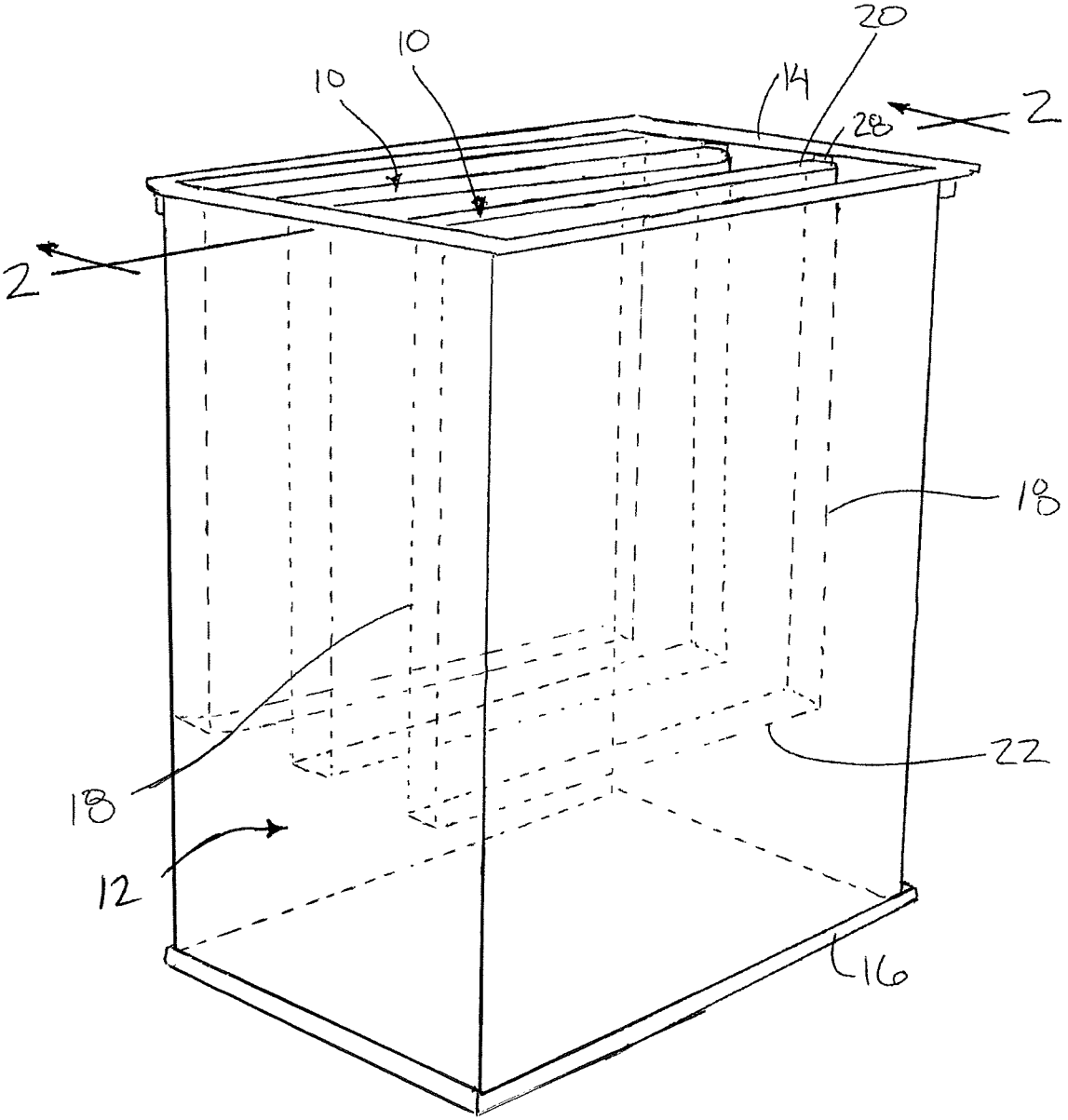
FIG. 1 is a perspective view of an exemplary duct locating a silencer comprising sound attenuating baffles according to the present invention therein.
Figure 2:
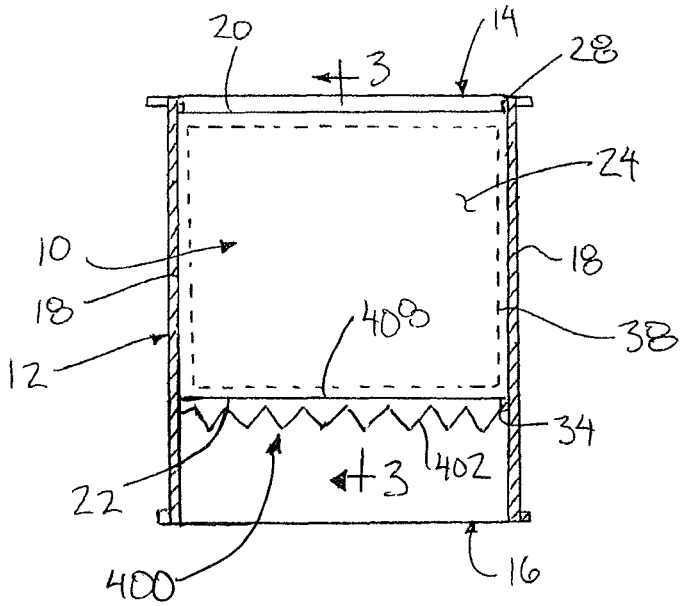
FIG. 2 is a schematic sectional view along the line 2-2 of FIG. 1.
Figure 3:
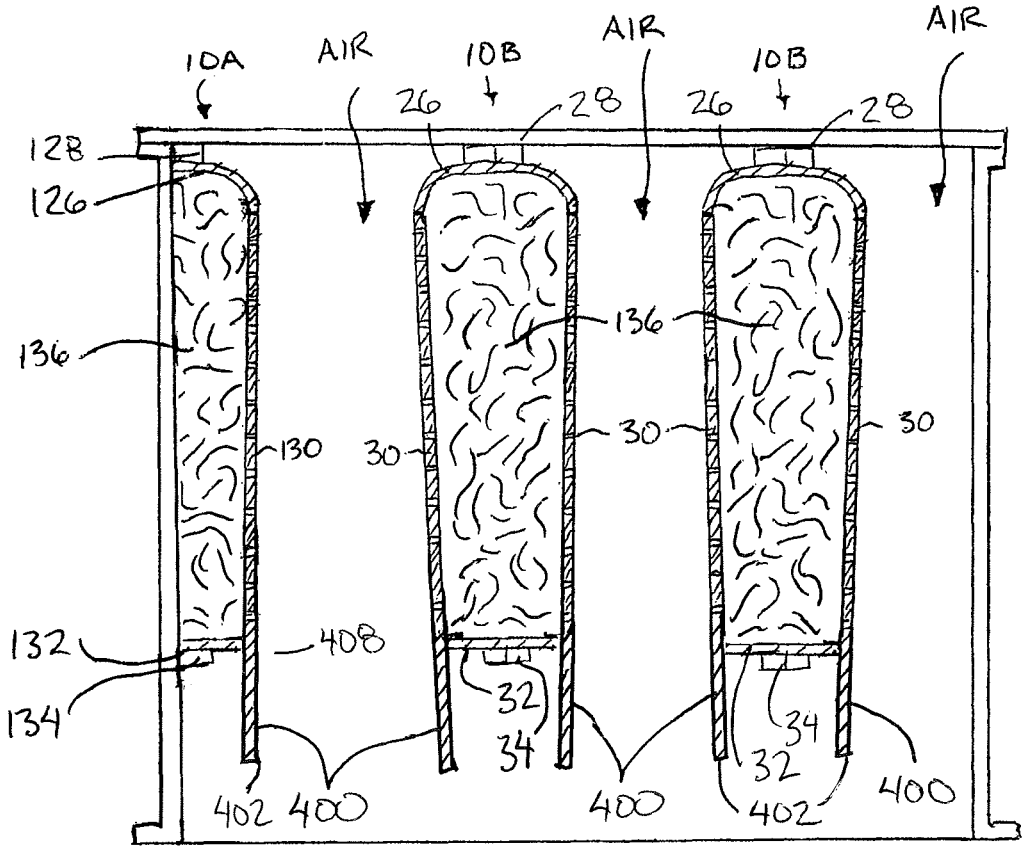
FIG. 3 is a schematic sectional view along the line 3-3 of FIG. 2 of a plurality of baffles.

Referring to the accompanying figures there is illustrated a trailing member 400 for a sound attenuating baffle device 10 of the type used in a silencer apparatus for attenuating sound in a ducted flow. The duct may be any suitable size or shape for receiving a flow of air or gas therethrough in a flow direction of the duct in air distribution HVAC systems, ventilation systems and other air movement systems for either air and gas streams.

In the first illustrated embodiment, the duct is a rectangular duct section 12 having a rectangular cross-section of constant cross-sectional area from an inlet end 14 to an outlet end 16. In further embodiments however, the sound attenuating baffle device 10 can be readily applied to any other type of duct including duct sections with circular cross-sections, a straight duct section, or an elbow duct section while still achieving the benefits described herein. The flow direction through the duct is understood herein to correspond to the direction that air moves through the duct. In a straight duct, the flow direction is typically linear from the inlet to the outlet end of the duct; however, in an elbow duct, the flow direction is understood to follow a generally curved path from the inlet to the outlet of the duct.

The duct section 12 of the silencer apparatus is mounted within a duct system or directly to a fan, and is comprised of one or more sound attenuating baffle devices 10.

In the first illustrated embodiment, the silencer apparatus mounted within the duct 12 comprises one half-baffle device 10A mounted against one boundary wall of the duct section 12 and two intermediate baffle devices 10B which are mounted at respective intermediate locations within the duct section. The baffle devices 10A and 10B are all generally parallel and spaced apart from one another within the perimeter boundary of the duct.

Each baffle device 10 extends in a lateral direction across a full width of the duct between two opposing sides 18 of the baffle. Each baffle also extends in a longitudinal direction generally parallel to the flow through the duct from a leading end 20 of the baffle device to a trailing end 22. The baffle device is generally uniform in shape in the lateral direction across the full width. A thickness of the baffle device, measured perpendicularly to both the lateral and longitudinal directions, tapers in the flow direction so as to be reduced in overall thickness from the leading end 20 to the trailing end 22.

Each baffle device includes an outer baffle casing 24 in the form of a shell which defines the outer boundary of the baffle device. The outer baffle casing 24 of the half baffle 10A is approximately one half of the overall shape and size of each intermediate, full baffle device 106 according to the illustrated embodiment.

With regard to each intermediate baffle device 10B, the outer baffle casing 24 includes a first cap 26 spanning laterally across the full width of the baffle device at the leading end. The first cap 26 is formed of sheet metal and is generally concave at the outer side in the direction of the thickness of the baffle, while extending generally linearly across the full width of the baffle in the lateral direction with a uniform profile. The first cap 26 is typically formed to be devoid of perforations so as to be generally domed and aerodynamic in shape. In the illustrated embodiment mounting flanges 28 are formed at opposing ends of the first cap 26 for mounting two opposing side walls of the surrounding duct, however in further embodiments various other means may be used to support the baffle device relative to the duct.

The outer baffle casing 24 further comprises two opposed boundary walls comprising perforated metal sheet members 30 which are generally planar in shape for spanning the full width and substantially the full length of the outer baffle casing. The overall thickness of the baffle is defined by the distance between the two opposed boundary walls.

A second cap 32 is mounted between the perforated sheet members 30 at the trailing end of the baffle device to span the full width between opposing sides of the duct and to span the full thickness between the opposing boundary walls. The second cap 32 may be planar in shape, oriented perpendicularly to the flow direction through the duct. Mounting flanges 34 are also provided at opposing ends of the second cap 32 for mounting to opposing side walls of the duct according to the illustrated embodiment, however in further embodiments various other means may be used to support the baffle as noted above. The second cap 32 in the illustrated embodiment is a solid panel.

The perforated sheet members 30 defining the two opposed boundary walls of each baffle device 10B are oriented generally in the flow direction, however, the walls are sloped by a few degrees relative to the flow direction such that the two opposed walls taper towards one another to reduce the overall thickness therebetween in the flow direction from the first cap 26 at the leading end to the second cap 32 at the trailing end.

In the illustrated embodiment, a hollow interior of the resulting outer baffle casing 24 is filled with a sound absorbing material 36 which defines a sound absorbing layer occupying most of the thickness of the outer baffle casing. As shown in the figures, the hollow interior of the baffle casing is bounded in part by the boundary walls 30 and is bounded at the rear end of the hollow interior, corresponding to the trailing end of the baffle casing, by the rear cap 32. Sound absorbing materials suitable for use with the present invention include lightweight, porous or loose fill materials such as fibrous material including fiberglass, mineral wool, or natural cotton media for example, which have the ability to dissipate sound energy travelling therethrough.

The sound absorbing material 36 occupying the interior of the baffle devices in the illustrated embodiments is intended to represent just one example of a suitable sound attenuating structure within the interior of the baffle casing of the baffle device. In further embodiments, the sound attenuating structure within the interior of the baffle casing is comprised of internal divider members that define one or more hollow attenuating chambers within the interior of the baffle device for attenuating sound.

The half baffle device 10A is similar to the intermediate baffle devices 10B in that there is provided an outer baffle casing 124 which also forms the shell which defines the outer boundary wall of the baffle device. The outer baffle casing 124 again includes a first cap 126 spanning across the full width of the baffle device at the leading end so as to spend the full thickness of the baffle device. The first cap 126 is formed of sheet metal and is concave at the outer side, but corresponds approximately to only half of the profile of the first cap of the intermediate baffle devices. Mounting flanges 128 are formed at opposing ends of the first cap 126 for mounting two opposing side walls of the surrounding duct section.

The half baffle device 10A also includes a second cap 132 mounted at the trailing end of the baffle device to span the full width between opposing sides of the duct and to extend the full thickness of the baffle device the second cap 132 is oriented generally perpendicularly to the flow direction through the duct section. Mounting flanges 134 are formed at opposing ends of the second cap 132 for mounting two opposing side walls of the surrounding duct section.

The half baffle device 10A also includes a perforated metal sheet member 130 which spans the full width of the duct section and which extends substantially the full length of the outer baffle casing 124 between the first cap 126 at the leading end and the second cap 132 at the trailing end of the baffle device. The overall thickness of the baffle is defined by the distance between the perforated sheet member 130 and the adjacent boundary wall of the duct section in the instance of the half baffle device.

The hollow interior of the resulting outer baffle casing 124 of the half baffle device 10A is also filled with a sound absorbing material 136 which defines a sound absorbing layer occupying most of the thickness of the outer baffle casing. As noted above, sound absorbing materials suitable for use with the present invention include lightweight, porous or loose fill materials such as fibrous material including fiberglass, mineral wool, or natural cotton media for example, which have the ability to dissipate sound energy travelling therethrough.

In the instance of either a full baffle device 10B or a half baffle device 10A the perforated metal sheet member 30 or 130 defines a substantial portion of the exterior of the baffle casing which is oriented generally in the flow direction of the duct section and across which the gaseous flow through the duct section is directed in use. Each of the perforated sheet members includes a plurality of perforations formed therein. The perforations in the sheet members typically comprise the only openings in the overall shell formed by the baffle casing.

Figure 4:
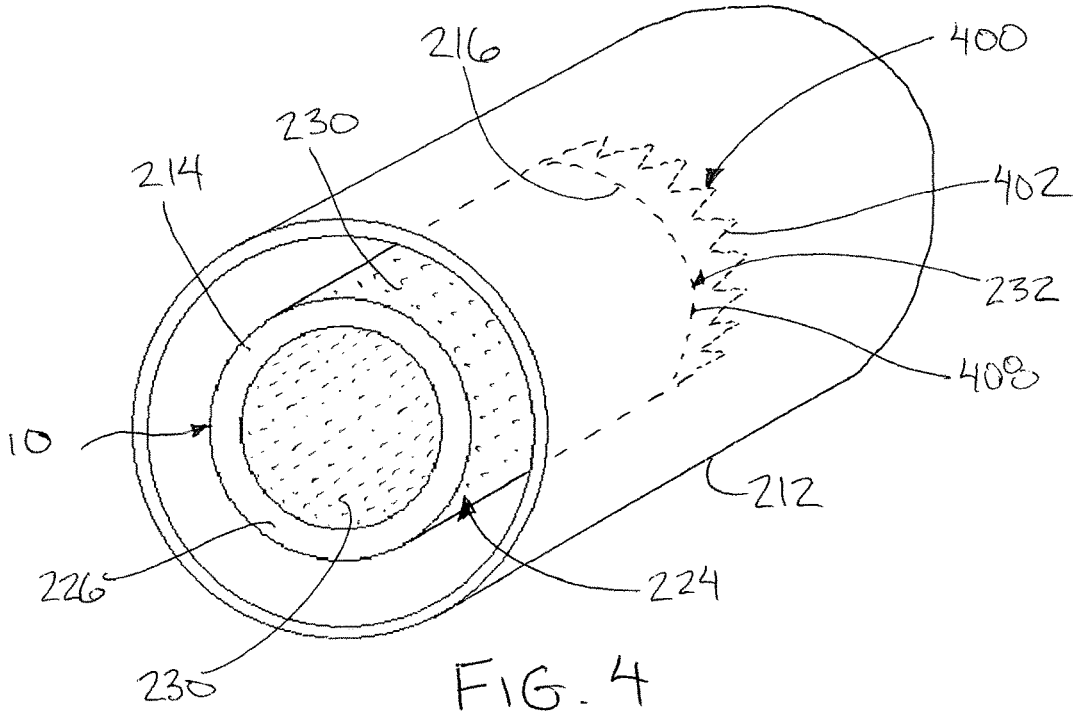
FIG. 4 is a perspective view of an alternative embodiment of the sound attenuating baffle according to the present invention when supported in a circular duct.

Turning now to the second embodiment of the duct shown in FIG. 4, the duct in this instance comprises a circular duct 212 which is cylindrical about a longitudinal axis from an inlet end 214 to an outlet end 216. The sound attenuating baffle device 10 in this instance comprises a circular baffle casing 224 which is also generally cylindrical in shape about a central axis of the duct so as to be concentrically received within the circular duct 212. The baffle casing 224 extends in the flow direction from a first annular cap 226 at the leading end of the baffle casing to a second annular cap 232 at the trailing end of the casing. The thickness of the baffle casing 224 is measured in the radial direction between opposing boundary walls 230 which are cylindrical in shape at the inner and outer faces of the baffle casing. Each of the first and second caps at the opposing ends of the circular baffle 212 spans the radial distance between the boundary walls 230 at the inner and outer sides of the baffle casing. The hollow interior of the baffle casing is again filled with sound absorbing material 236 which fully occupies the hollow interior in the radial direction between the inner and outer boundary walls 230 and in the axial direction between the first cap 226 at the leading end and the second cap 232 at the trailing end.

In all embodiments of the sound attenuating baffle device as described herein, the flow characteristics can be improved by the addition of a trailing member 400. The trailing member is formed of rigid sheet material to be mounted at the trailing edge portion of each of the boundary walls 30, 130 or 230. More particularly the trailing edge portion 408 is defined as the trailing edge of the boundary wall at the intersection of the boundary wall with the cap at the trailing end of the baffle casing. In the first embodiment, the trailing edge portion is a linear edge extending perpendicularly to the flow direction across the full width of the baffle casing corresponding to the full width of the duct. In the second embodiment, the trailing edge portion is a circular edge lying in a plane oriented perpendicularly to the flow direction to extend about the full outer circumference of the circular baffle casing in the instance of the outer boundary wall and to extend about the full inner circumference of the circular baffle casing in the instance of the inner boundary wall.

In each instance, the sheet material forming the trailing member 400 is mounted to protrude rearwardly in the flow direction beyond the trailing end of the baffle casing so as to be parallel to or substantially coplanar with the boundary wall from which the trailing member protrudes such that at least a portion of the trailing member is spaced rearwardly of the trailing edge portion at the rear trailing end of the baffle casing as shown in FIGS. 4 to 7. As shown in the accompanying Figures, the rigid sheet material forming the trailing member is flat in said longitudinal direction of the baffle casing that extends from the leading end to the trailing end of the baffle casing. The trailing member protrudes rearwardly from the trailing end of the casing to a rear free edge 402 of the trailing member which is spaced rearwardly of the trailing edge portion at the rear trailing end of the baffle casing and which is a nonlinear edge so as to be non-parallel to the trailing edge portion of the corresponding boundary wall upon which the trailing member is supported. More particularly the free edge 402 at the rear of the trailing member defines a plurality of individual protruding elements 404 spaced apart along the length of the trailing member to define a recess 406 between each adjacent pair of protruding elements. The protruding elements are substantially identical to one another and may have various shapes. When provided with a curved profile edge, the resulting free edge of the trailing member may follow a sinusoidal pattern. Alternatively, when the protruding elements are generally triangular or rectangular in shape, the resulting free edge 402 has a V-shape or stepped profile respectively, continuously along the termination thereof as shown in the various embodiments illustrated in FIGS. 5 through 7.

Figure 5:
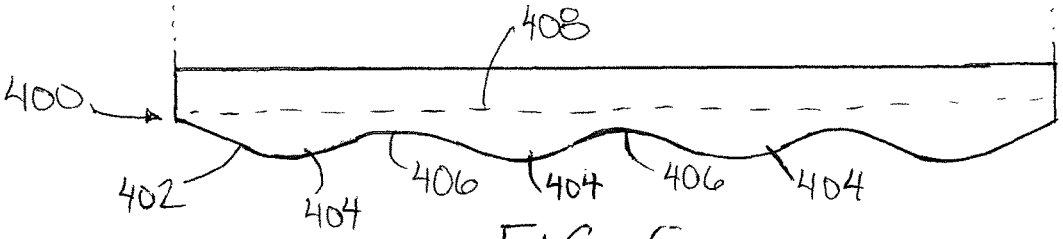
FIG. 5 is a plan view of a first embodiment of the trailing member supported on the sound attenuating baffles according to the present invention.
Figure 6:
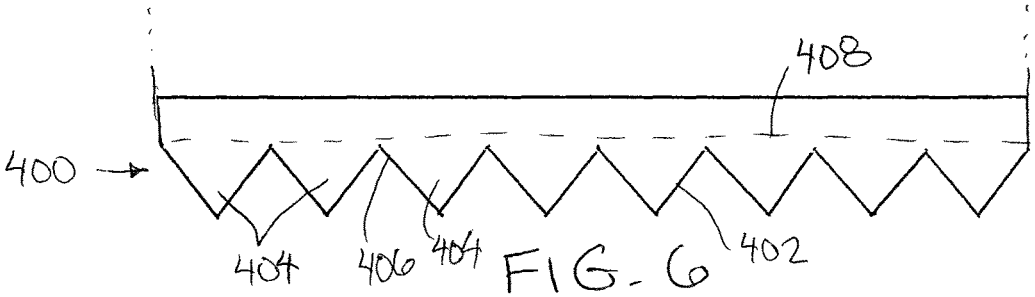
FIG. 6 is a plan view of a second embodiment of the trailing member.
Figure 7:
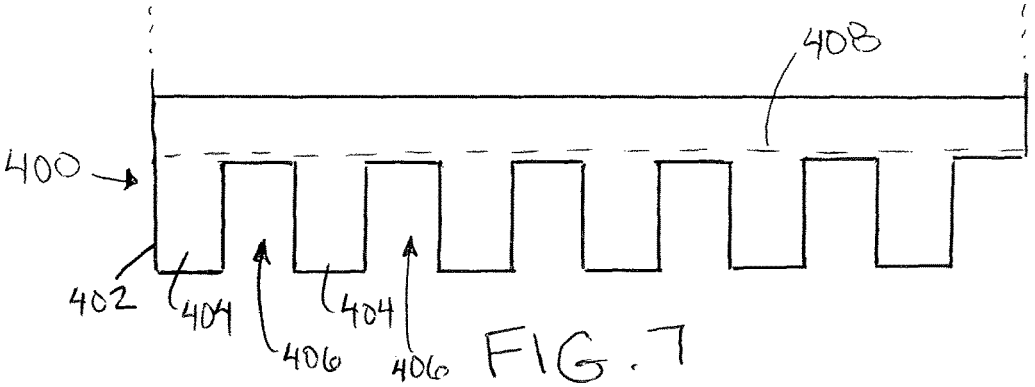
FIG. 7 is a plan view of a third embodiment of the trailing member.
Figure 8:
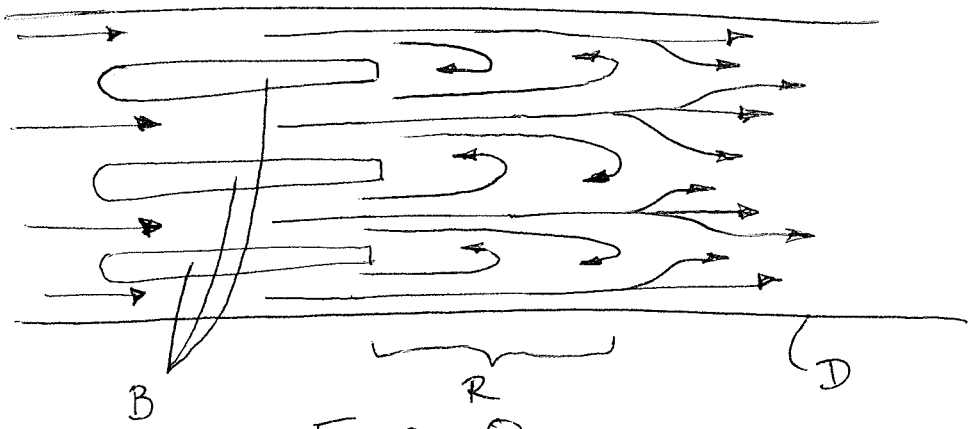
FIG. 8 is a schematic representation of a bounded flow within a duct using a prior art arrangement of sound attenuating baffle devices.
Figure 9:
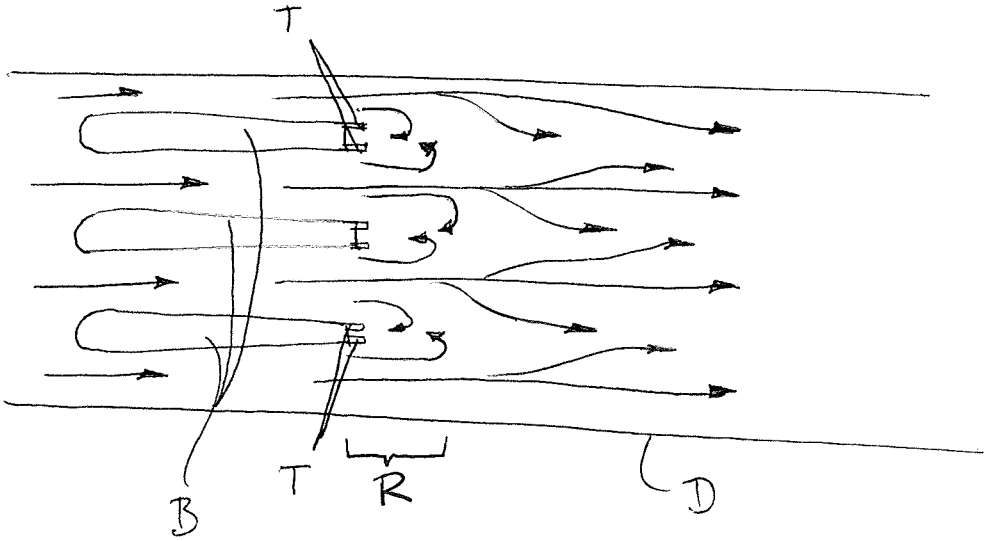
FIG. 9 is a schematic representation of a bounded flow within a duct using sound attenuating baffle devices according to the present invention in which the flow recirculation zone (distance R downstream from the baffle) is significantly less than the recirculation zone noted in FIG. 8.

The length that each protruding element protrudes beyond the trailing end of the baffle to the apex of the protruding element in preferred embodiments may be in the range of 1 to 4 inches. The width of each protruding element may be in the range of 0.5 to 8 inches. FIGS. 5 through 7 illustrate various exemplary embodiments of the trailing member within the range of dimensions noted above.

In either instance, the overall length of the resulting free edge 402 is typically much greater than the length of the trailing edge portion of the boundary wall upon which the trailing member is supported. For example, the free edge may have a length which is between 100% and 400% of the length of the trailing end portion of the boundary wall supporting the trailing member thereon, however, a free edge which is 150% or more of the length of the trailing edge portion of the boundary wall is believed to be most effective.

The trailing member 400 is believed to have considerable benefits on a range of sound attenuating baffle devices, and particularly those in which the baffle device has a baffle thickness equal to or greater than 6 inches, a baffle height equal to or greater than 18 inches, and a length in the flow direction which is equal to or greater than 36 inches.

The trailing member serves to increase the overall length (i.e., increase the "virtual length") of the trailing edge which is believed to reduce the dump loss from the sound attenuating baffles abrupt expansion, as well as reduce the recirculation zone size and improve the flow diffusion as part of the airflow diffusion occurring closer downstream to the silencer. Accordingly, airflow distributed across the increased effective length of the trailing edge may result in a lower pressure drop, reduced airflow generated noise, and reduced system effects such as adverse interactions between the silencer and other duct components.

Figure 10:
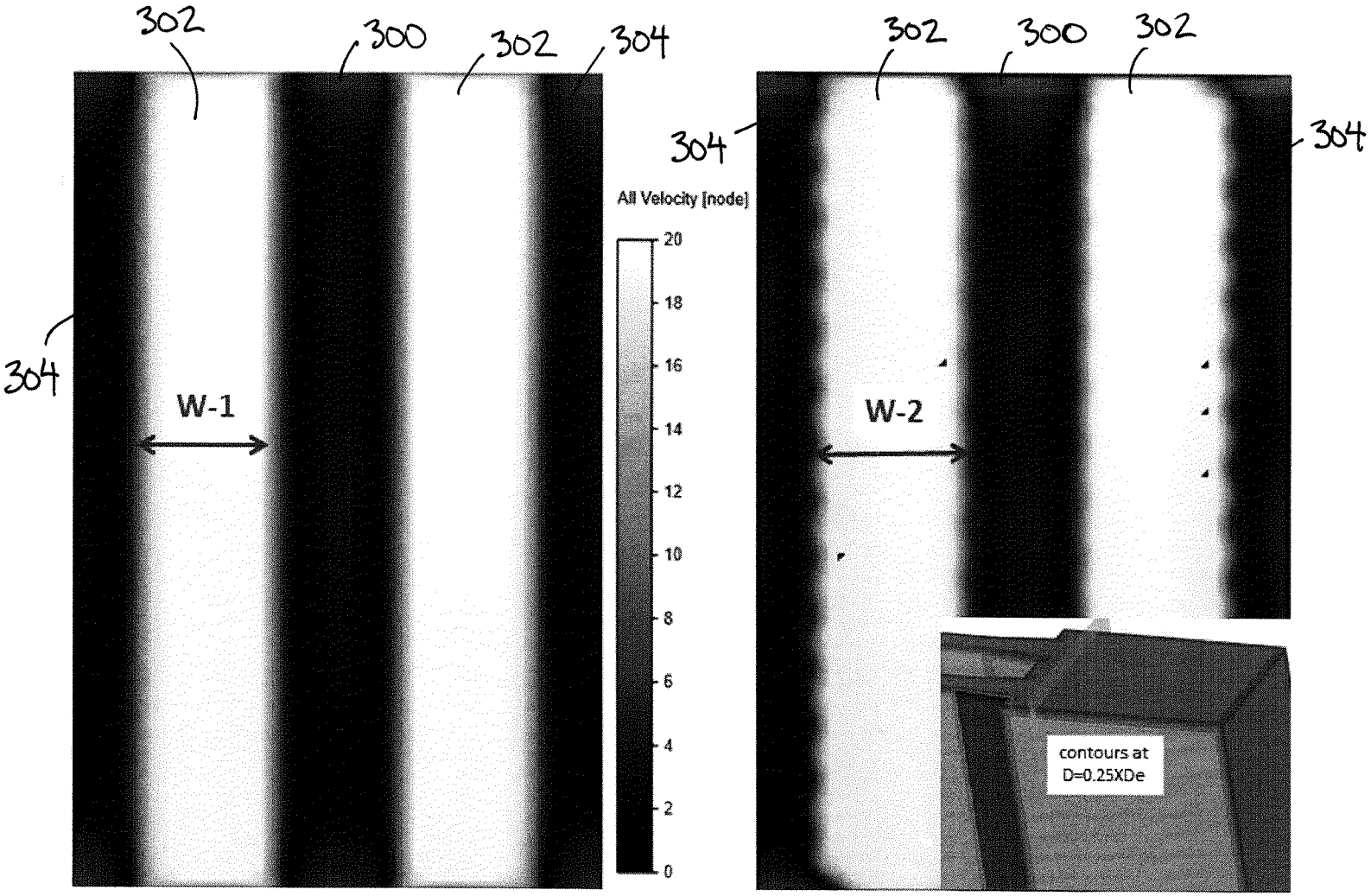
FIG. 10 is a typical fluid modelling plot of the velocity contours (m/s) for the airflow leaving a two air passage silencer, with and without the present invention therein, in which the velocity contour is plotted at a distance downstream from the silencer air passage of 0.25×De (De=equivalent duct diameter)
Figure 11:
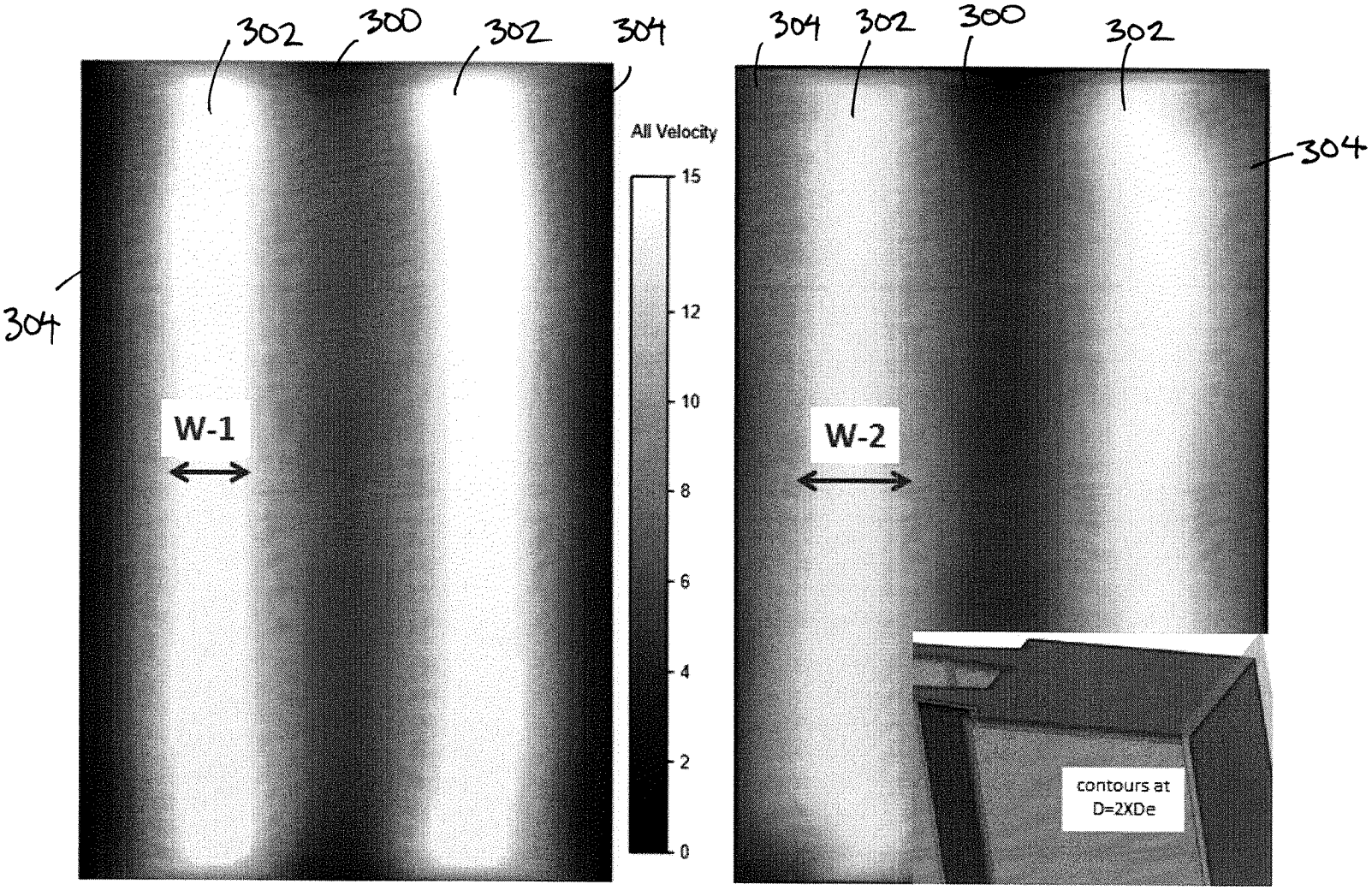
FIG. 11 is a typical fluid modelling plot of the velocity contours (m/s) for the airflow further downstream from a two air passage silencer, with and without the present invention therein in which the velocity contour is plotted at a distance downstream from the air passage of 2.0×De.

As shown in FIGS. 10 and 11 a typical fluid modelling plot of the velocity contours (m/s) for the airflow leaving a two air passage silencer, with and without the present invention therein. In each Figure, two plots are provided which represent fluid modelling without an additional trailing member attached in the left side image and with the additional trailing member attached in the right side image. The velocity contour is plotted at a distance downstream from the silencer air passage of 0.25×De (De=equivalent duct diameter) in FIG. 10, and of 2.0×De in FIG. 11.

Each plot represents the velocity measurements across a plane intersecting the duct at right angles to the flow direction in which the darker region 300 spanning vertically across the plot at a laterally centered location represents flow downstream from a single baffle between two air passages and in which the lighter regions 302 represents flow downstream from the two air passages. The darker regions 304 spanning vertically across the plot at laterally opposing side edges represent flow downstream from boundary baffles at the opposing sides of the duct. As noted in the side-by-side comparison in each of FIGS. 10 and 11, the outlet flow diffusion or velocity distribution is improved, and the pressure drop is significantly reduced with the addition of the trailing member. The velocity distribution improvement is observed through a wider region of flow dispersion with the trailing member in place. Furthermore, in FIG. 11, both the velocity distribution is improved and the peak velocity is reduced. These airflow improvements at this relatively close position to the silencer help reduce unwanted system effects.

Figure 12:
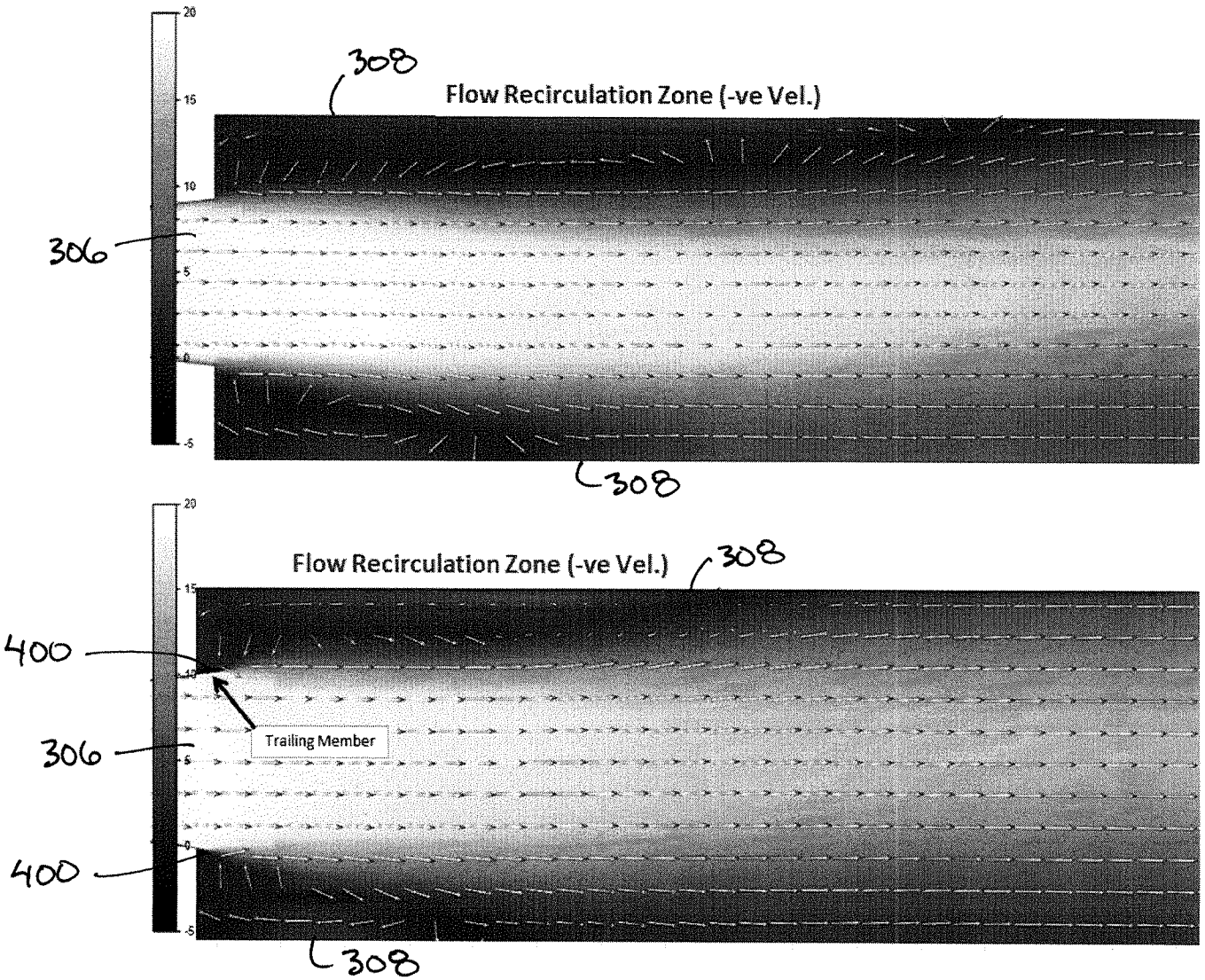
FIG. 12 is a typical fluid modelling plot of the velocity contours (m/s) for the airflow propagating downstream from a silencer, with and without the present invention therein.

Turning now to FIG. 12, in this instance fluid modelling plots of the velocity contours (m/s) for the airflow propagating downstream from a silencer are shown which represent fluid modelling without an additional trailing member attached in the left side image and with the additional trailing member attached in the right side image. Each plot represents flow velocity measurements in a duct having a single flow passage between two boundary baffles across a plane which is both (i) perpendicular to the boundary baffles and (ii) parallel to the flow direction intersecting the plane of the baffles. The lighter region 306 spanning laterally across the plot represents the flow region downstream of the flow passage between the two boundary baffles as it flows from left to right. The darker regions 308 extending laterally across the top and bottom boundaries of the plot represent flow downstream from the two boundary baffles. The trailing members 400 at the trailing end of the two boundary baffles are represented schematically in FIG. 12 at opposing sides of the flow passage between the two boundary baffles. Velocity vectors are also provided on the plot to represent the flow direction. As noted in the side-by-side comparison, the flow recirculation zone is significantly reduced with the addition of the trailing members 400. The turbulent regions downstream from each boundary baffle are reduced when using trialing members 400 so that the flow more quickly returns to a laminar flow in the same direction across the full width of the duct so that fully recovered flow occurs at a shorter distance downstream from the silencer.

When the sound attenuating baffle has an axial length of less than 24 inches, a suitable configuration of the protruding elements is to have a lateral width of 0.5 inches and an axial length of 2 inches.

When the sound attenuating baffle has an axial length of between 24 and 48 inches, a suitable configuration of the protruding elements is to have a lateral width of 2 inches and an axial length of 2 inches.

When the sound attenuating baffle has an axial length of greater than 48 inches, a suitable configuration of the protruding elements is to have a lateral width of 3.0 inches and an axial length of 2 inches.

Since various modifications can be made in my invention as herein above described, it is intended that all matter contained in the accompanying specification shall be interpreted as illustrative only and not in a limiting sense.

The invention claimed is:

1. A sound attenuating baffle device for use in a duct receiving a gaseous flow in a flow direction therethrough from an inlet end to an outlet end of the duct, the baffle device comprising:

a baffle casing including at least one boundary wall spanning rearwardly along one side of the baffle casing in a longitudinal direction of the baffle casing from a leading end to a trailing end of the baffle casing;

the baffle casing including a hollow interior bounded in part by said at least one boundary wall and bounded at the trailing end of the baffle casing by a rear cap of the baffle casing;

the baffle casing being adapted to be supported within the duct such that said at least one boundary wall is oriented in the flow direction and the gaseous flow is directed rearwardly across said at least one boundary wall from the leading end to the trailing end of the baffle casing;

a sound attenuating structure supported within the hollow interior of the baffle casing, the sound attenuating structure being adapted to attenuate sound; and a trailing member associated with said at least one boundary wall and supported on the baffle casing so as to protrude rearwardly away from the baffle casing in a direction of the boundary wall beyond the rear cap of the baffle casing at the trailing end of the baffle casing towards a free trailing edge of the trailing member such that at least a portion of the trailing member is spaced rearwardly of the rear cap that bounds the hollow interior of the baffle casing at the trailing end of the baffle casing;

the free trailing edge at a rear end of the trailing member being non-linear in profile; and the trailing member associated with said at least one boundary wall being formed of rigid sheet material, the rigid sheet material being flat in said longitudinal direction of the baffle casing.

2. The baffle device according to claim 1 wherein an intersection of said at least one boundary wall and the rear cap of the baffle casing defines a trailing edge portion of the boundary wall, wherein the trailing member associated with said at least one boundary wall protrudes from the trailing edge portion of said at least one boundary wall, and wherein the free trailing edge of the trailing member associated with said at least one boundary wall is greater in length than the trailing edge portion of said at least one boundary wall.

3. The baffle device according to claim 2 wherein the free trailing edge of the trailing member associated with said at least one boundary wall is at least 50% longer than the trailing edge portion of said at least one boundary wall.

4. The baffle device according to claim 2 wherein the free trailing edge of the trailing member associated with said at least one boundary wall is at least twice as long as the trailing edge portion of said at least one boundary wall.

5. The baffle device according to claim 1 wherein the rigid sheet material of the trailing member is parallel to the boundary wall associated therewith.

6. The baffle device according to claim 1 wherein the rigid sheet material of the trailing member is coplanar with the boundary wall associated therewith.

7. The baffle device according to claim 1 wherein the rigid sheet material of the trailing member is continuous with the boundary wall associated therewith so as to be joined integrally and seamlessly therewith.

8. The baffle device according to claim 1 wherein the free trailing edge of the trailing member associated with said at least one boundary wall comprises a plurality of protruding elements mounted in series with one another in a row so as to define a recess between each adjacent pair of the protruding elements.

9. The baffle device according to claim 8 wherein the protruding elements and the recesses therebetween are triangular in shape.

10. The baffle device according to claim 8 wherein the protruding elements and the recesses therebetween are sinusoidal in profile.

11. The baffle device according to claim 8 wherein each protruding element has a length extending rearwardly from the casing which is greater than a width of the protruding element in the direction of said row.

12. The baffle device according to claim 8 wherein each protruding element has a width in the direction of said row which is greater than a length of the protruding element extending rearwardly from the casing.

13. The baffle device according to claim 1 wherein the sound attenuating structure comprises a sound absorbing material within the hollow interior of the baffle casing.

14. The baffle device according to claim 1 wherein the sound attenuating structure comprises at least one sound attenuating chamber within the hollow interior of the baffle casing.

15. A sound attenuating duct assembly comprising:

a duct for receiving a gaseous flow in a flow direction therethrough from an inlet end to an outlet end of the duct;

a baffle casing supported with the duct, the baffle casing including at least one boundary wall spanning rearwardly along one side of the baffle casing so as to be oriented in the flow direction of the duct to extend in a longitudinal direction of the baffle casing from a leading end to a trailing end of the baffle casing and so as to be arranged to receive the gaseous flow directed across said at least one boundary wall;

the baffle casing including a hollow interior bounded in part by said at least one boundary wall and bounded at the trailing end of the baffle casing by a rear cap of the baffle casing;

a sound attenuating structure supported within the hollow interior of the baffle casing, the sound attenuating structure being adapted to attenuate sound; and a trailing member associated with said at least one boundary wall and supported on the baffle casing so as to protrude rearwardly away from the baffle casing in a direction of the boundary wall beyond the rear cap of the baffle casing at the trailing end of the baffle casing towards a free trailing edge of the trailing member such that at least a portion of the trailing member is spaced rearwardly of the rear cap that bounds the hollow interior of the baffle casing at the trailing end of the baffle casing;

the free trailing edge at a rear end of the trailing member being non-linear in profile; and the trailing member associated with said at least one boundary wall being formed of rigid sheet material, the rigid sheet material being flat in said longitudinal direction of the baffle casing.

16. The duct assembly according to claim 15 wherein the free trailing edge comprises a plurality of protruding elements mounted in series with one another in a row so as to define a recess between each adjacent pair of the protruding elements.

17. The duct assembly according to claim 15 wherein an intersection of said at least one boundary wall and the rear cap of the baffle casing defines a trailing edge portion of the boundary wall, wherein the trailing member associated with said at least one boundary wall protrudes from the trailing edge portion of said at least one boundary wall, and wherein the free trailing edge of the trailing member associated with said at least one boundary wall is greater in length than the trailing edge portion of said at least one boundary wall.

18. A method of reducing pressure drop across a sound attenuating baffle device within a duct in which the duct receives a gaseous flow in a flow direction therethrough from an inlet end to an outlet end of the duct and in which the sound attenuating baffle device comprises (i) a baffle casing supported with the duct including at least one boundary wall spanning rearwardly along one side of the baffle casing so as to be oriented in the flow direction of the duct to extend in a longitudinal direction of the baffle casing from a leading end to a trailing end of the baffle casing, the baffle casing including a hollow interior bounded in part by said at least one boundary wall and bounded at the trailing end of the baffle casing by a rear cap of the baffle casing, and (ii) a sound attenuating structure within the hollow interior of the baffle casing in which the sound attenuating structure is adapted to attenuate sound, wherein the method comprises:

providing a trailing member formed of rigid sheet material in association with said at least one boundary wall, the trailing member including a free trailing edge which is non-linear in profile; and supporting the trailing member associated with said at least one boundary wall to protrude rearwardly away from the baffle casing in a direction of the boundary wall beyond the rear cap of the baffle casing at the trailing end of the baffle casing towards the free trailing edge of the trailing member which is non-linear in profile such that: (i) at least a portion of the trailing member is spaced rearwardly of the rear cap that bounds the hollow interior of the baffle casing at the trailing end of the baffle casing and (ii) the rigid sheet material is flat in said longitudinal direction of the baffle casing.

* * * * *